US010859347B1

(12) United States Patent
Trampenau

(10) Patent No.: US 10,859,347 B1
(45) Date of Patent: Dec. 8, 2020

(54) CIVILIAN BULLET-PROOF SHIELD

(71) Applicant: Joseph B Trampenau, San Jose, CA (US)

(72) Inventor: Joseph B Trampenau, San Jose, CA (US)

( * ) Notice: Subject to any disclaimer, the term of this patent is extended or adjusted under 35 U.S.C. 154(b) by 0 days.

(21) Appl. No.: 16/936,072

(22) Filed: Jul. 22, 2020

Related U.S. Application Data

(63) Continuation-in-part of application No. 16/713,823, filed on Dec. 13, 2019.

(51) Int. Cl.
*F41H 5/08* (2006.01)
*F41H 5/26* (2006.01)

(52) U.S. Cl.
CPC ..... *F41H 5/08* (2013.01); *F41H 5/263* (2013.01)

(58) Field of Classification Search
CPC ..... F41H 5/08; F41H 5/14
See application file for complete search history.

(56) References Cited

U.S. PATENT DOCUMENTS 2,209,654 A * 7/1940 Loeser, Jr. ..... F41H 5/08 89/36.09
3,559,802 A * 2/1971 Eidus ..... B65G 39/025 206/318
4,781,101 A * 11/1988 Zevuluni ..... F41H 5/14 109/49.5
5,850,052 A * 12/1998 Gabriel ..... F41H 5/08 89/36.05
8,015,910 B1 * 9/2011 Fuqua ..... F41H 5/14 89/36.09
9,783,001 B1 * 10/2017 Panter ..... B60B 33/0028
10,267,601 B1 * 4/2019 Beck ..... F41H 5/14
10,619,978 B1 * 4/2020 Ackley ..... F41H 5/02
2006/0279054 A1 * 12/2006 Chung ..... B62B 5/0083 280/79.11
2010/0011950 A1 * 1/2010 White ..... F41H 5/06 89/36.09
2014/0238225 A1 * 8/2014 Mickiewicz ..... F41H 5/08 89/36.07
2016/0216080 A1 * 7/2016 Gonda ..... F41H 5/14
2019/0033040 A1 * 1/2019 White ..... F41H 5/06
2020/0018575 A1 * 1/2020 Nibert ..... F41H 5/18

FOREIGN PATENT DOCUMENTS

DE 202018005907 U1 * 1/2019 ..... F41H 5/08
JP 07332896 A * 6/1994 ..... F41H 5/08
KR 20090009838 U * 9/2009 ..... F41H 5/08

* cited by examiner

*Primary Examiner* — Gabriel J. Klein
(74) *Attorney, Agent, or Firm* — Donald R Boys; Central Coast Patent Agency LLC

(57) ABSTRACT

A shield has a rectangular body, one or more window openings, bullet-resistant glass panes in the windows, handles positioned along edges of the body on the backside, two or more rollerball bearings implemented along the lowermost edge of the body, and two wheels on axles with axes in the direction of the width of the body, the wheels positioned by brackets joined to the backside of the body proximate the lowermost edge. A user, grasping the handles, is enabled to hold the shield vertically oriented supported on the rollerball bearings and to move the shield side-to-side on the rollerball bearings, and wherein the user is further enabled to tilt the shield back toward the user, transferring support to the wheels rather than the rollerball bearings, and is then enabled to move the shield forward and backward on the ground or floor surface on the wheels.

8 Claims, 9 Drawing Sheets

CIVILIAN BULLET-PROOF SHIELD

CROSS-REFERENCE TO RELATED DOCUMENTS

The present application is a continuation-in-part application of co-pending application Ser. No. 16/713,823, filed Dec. 13, 2019, and all disclosure of the parent case is incorporated at least by reference.

BACKGROUND OF THE INVENTION

1. Field of the Invention

The present invention is in the technical area of bullet-proof shields and pertains more particularly to apparatus to protect people in groups from attack by particularly gun (or knife) wielding assailants.

2. Description of Related Art

There exist in the art many forms and varieties of bullet-proof shields, most of which are apparatus to be carried for protection and used in an offensive manner with a firearm. There seems to be an unmet need for a shielding apparatus usable by civilians in a situation such as an assailant in a school/office setting, or other setting where a relatively large group of potential victims is assembled. There are many well-known instances, for example, of attacks in schools, where students are caught by surprise, and must run or hide for protection.

What is clearly needed is a large shield with wheels or rollerballs (due to the weight of the shield) capable of stopping all manner of firearms, especially assault rifles, that may be used by one person to provide cover from an assailant or to hit/ram the attacker with the shield to protect other potential victims.

BRIEF SUMMARY OF THE INVENTION

In one embodiment of the invention a . . . .

DETAILED DESCRIPTION OF THE INVENTION

Figure 1A:
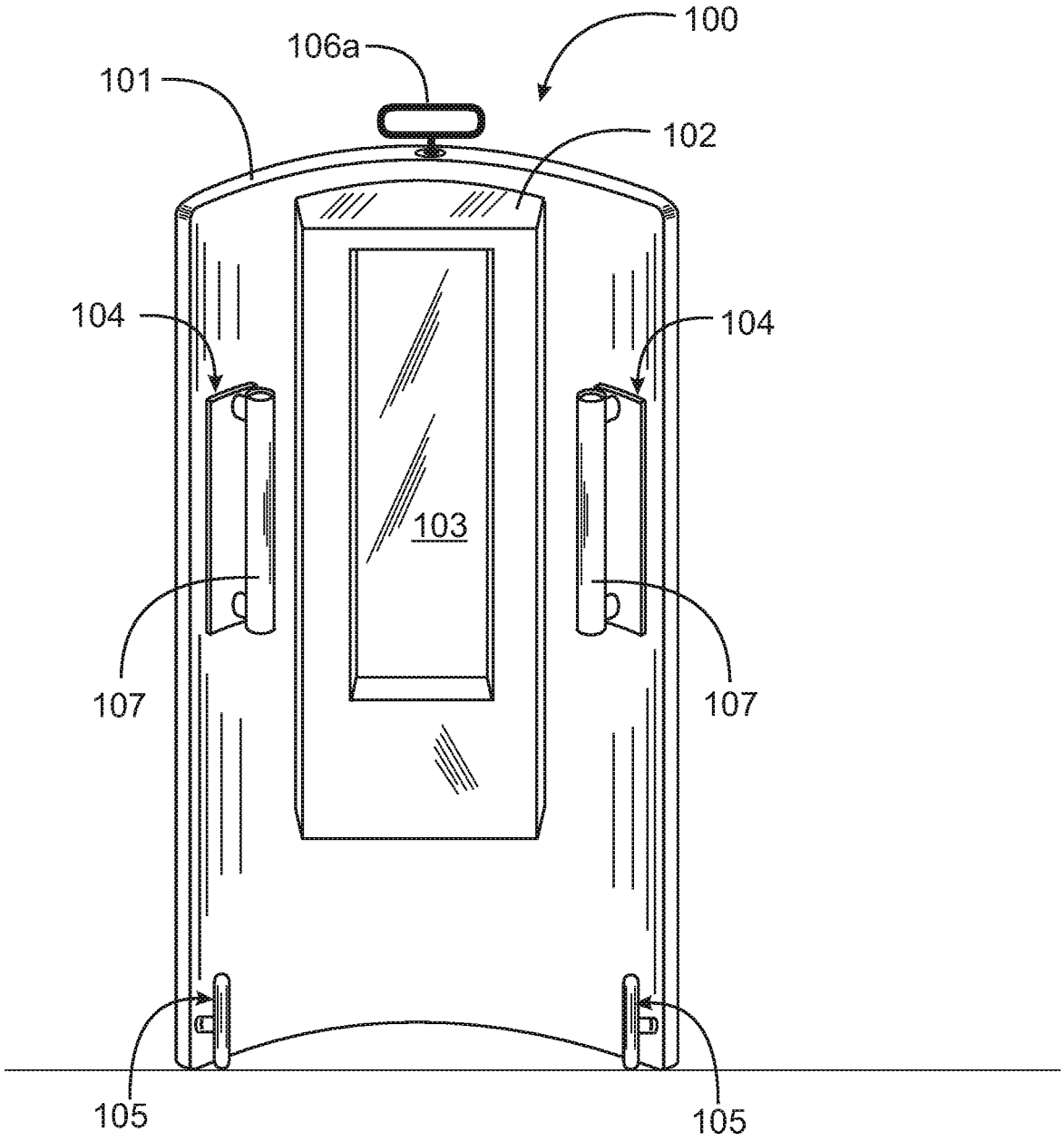
FIG. 1A is a perspective view of an apparatus in one embodiment of the invention.

FIG. 1A is a perspective view of an apparatus 100 in one embodiment of the invention. Apparatus 100 comprises in this example a curved body 101 of a substantial height, in this example six feet (72 inches) tall. In other embodiments the height may vary, in part to accommodate users of different height. The body in most embodiments is at least 60 inches high. Body 101 may be formed of single metal, such as cold-rolled steel, multi-metal laminates, ballistic steel, Kevlar™, or potentially any material capable of stopping a bullet. In this example the overall width of the curved body is at least twenty-four inches, but both the height and the width may vary somewhat in different embodiments. The thickness may be at least one-eighth inch but may be thicker in many embodiments. A central purpose is to provide a shield that will protect completely a standing person.

Apparatus 100 in one embodiment has two wheels 105 at the lower extremity, the wheels on axels that extend from the body orthogonal to a plane defined by the front edges of the body. In a preferred embodiment the wheels are inboard of the edges of the side edges of the shield as shown. The wheels are of a diameter, and the axels at a height, that with the body supported on its bottom surface the wheels are just touching the supporting surface but bear no weight.

Figure 1B:
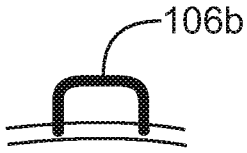
FIG. 1B is a partial view of the apparatus of FIG. 1A showing an alternative handle.
Figure 1C:
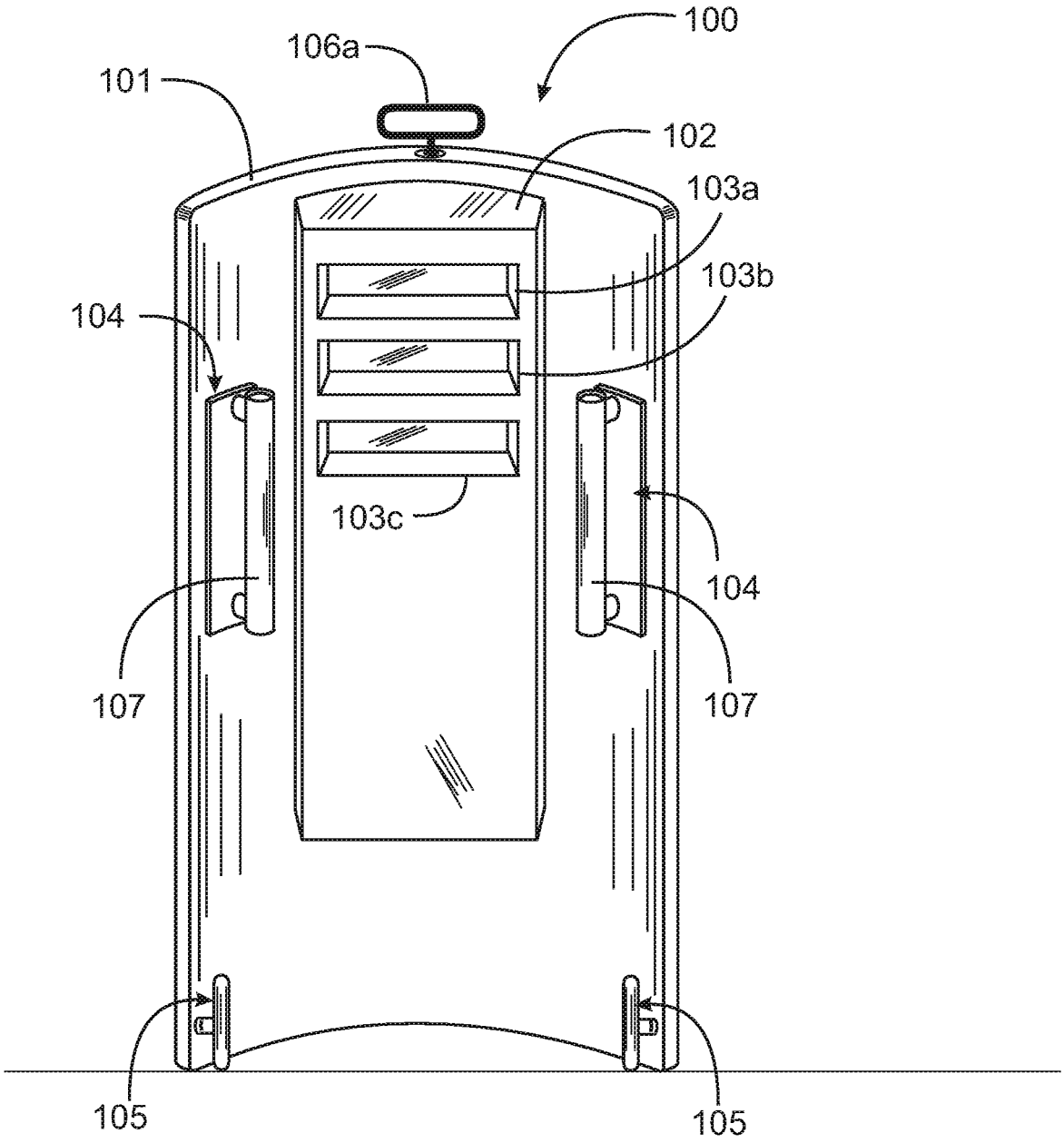
FIG. 1C is a perspective view of an alternative embodiment of the apparatus, with three windows.

In this example a cushioning pad 102 of from one to three inches in thickness is implemented on the inside of body 101 as shown in FIG. 1. The pad may be thinner or thicker in other embodiments. This pad may be formed of any convenient compressible material, such as synthetic or natural foam rubber, or other compressible polymer material. In one embodiment the pad may be a shell of fabric stuffed with cushioning material. The pad may be joined to body 101 in one example by a strong adhesive. In some embodiments the pad may be nearly the full height of body 101, and in others of a lesser height, as shown in FIG. 1. In this example pad 102 extends nearly to the top of the body. A purpose of the padding material relates to a principal use of the shield. In some embodiments the shield may be maneuvered by a user to attack an assailant, such as by pushing the shield with force into the assailant, while the body protects the user against gunfire from the assailant. The cushioning pad 102 is to protect the user from sudden shock in such a use. The attached pad will also reduce vibration of the shield when struck by a projectile, making it more comfortable to hold.

In this example a bullet-proof window 103 is implemented through an opening in body 101 and also through cushioning pad 102. A purpose of the window is to enable the user to see the assailant, and to be able to maneuver the shield without exposing the user to gunfire or other reaction from the assailant. The vertical nature of the window allows for users of varying heights to see clearly through the shield. In an alternative embodiment shown in FIG. 1C there may be multiple widows, perhaps three, one above the other, through the cushioning pad.

Two handle assemblies 104 are fastened to the inner surface (concave side) of body 101 as shown in FIG. 1 in this example. Each handle assembly 104 comprises a vertically oriented handle 107. In one embodiment the handles may be from about eight inches to as much as twenty-four inches long, and from one to two inches in diameter, but these dimensions may also vary in other embodiments. The handles would typically be padded and may be spaced apart from body 101 by as much as ten to twelve inches, to enable a user to run with the shield held by the handles and if needed, to be rolled on its wheels 105. In attacking an assailant velocity may be quite important. The vertical nature of the double handles allows for users of varying heights to comfortably/efficiently handle/manipulate the shield. Due to the weight and handle design the shield would also not be useful for an active shooter if they tried to use one to their advantage.

Apparatus 100 in one embodiment has a storage loop 106 fastened to body 101 in this embodiment at about the middle of the body horizontally. Loop 106 in this example is a flattened oval providing both a loop to hang the apparatus from a wall hook, and a handle to be grasped by the user to help move and tilt the apparatus in use.

Figure 2A:
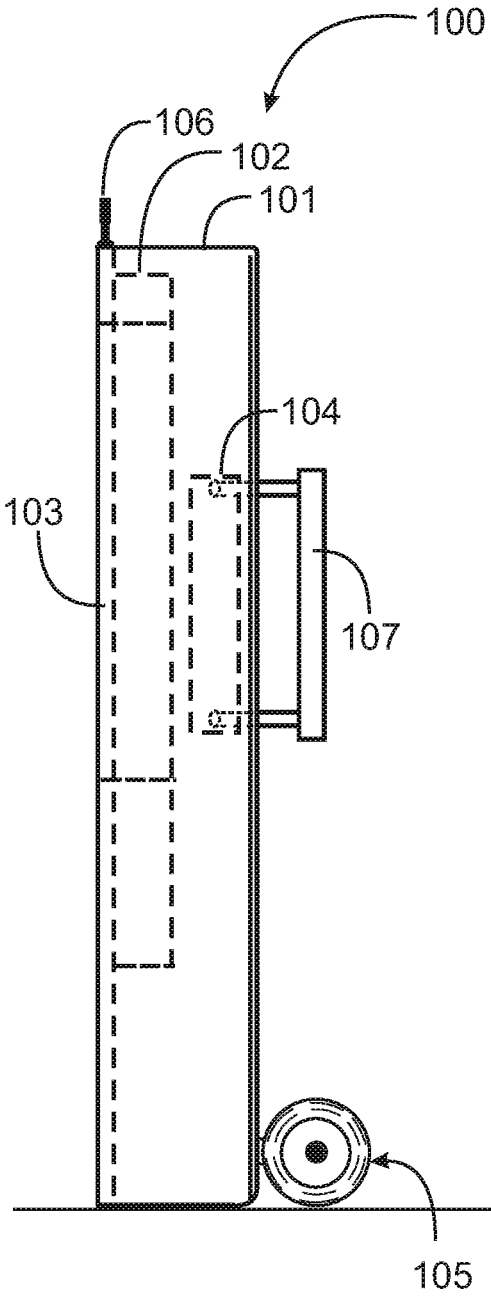
FIG. 2A is a side elevation view of the apparatus of FIG. 1.

FIG. 2A is a side elevation view of the apparatus of FIG. 1, standing upright on a floor, supported on the base of the curved body. It may be seen in this view that wheels 105 are very close to the floor, but do not touch, and bear no weight of the apparatus. In this example leading edges 108 of the curved shield at the floor line are rounded.

Figure 2B:
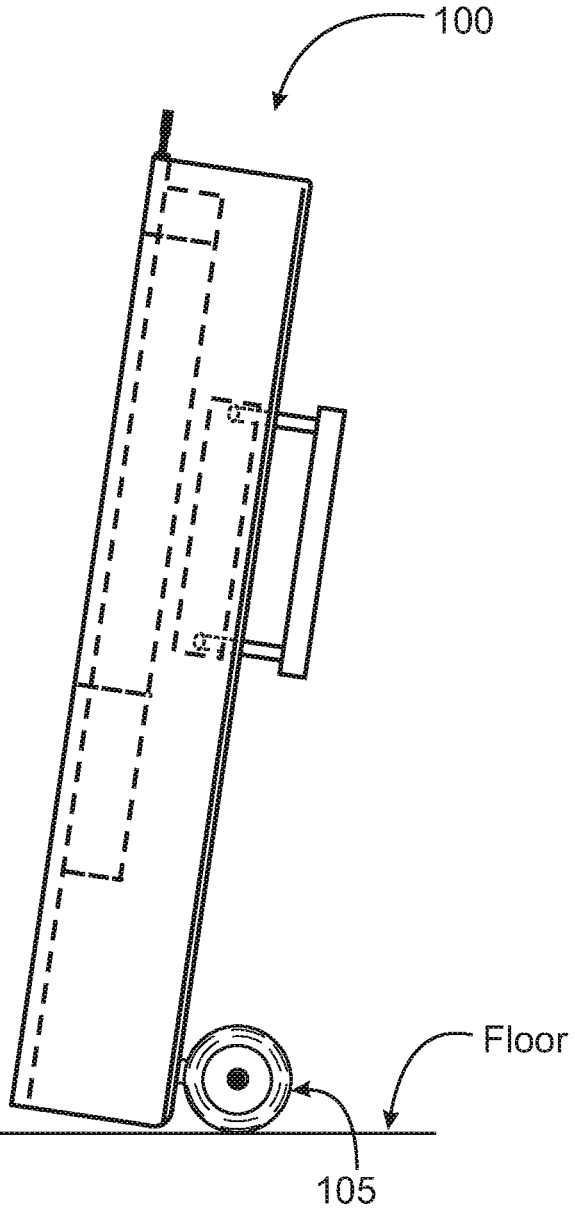
FIG. 2B is a side elevation view of the apparatus of FIG. 2A tilted on to the wheels.

FIG. 2B illustrates apparatus 100 of FIG. 2A tilted backward by a user holding handles 107, such that the wheels contact the supporting surface and bear the weight of the apparatus. In a typical use case, there may be, for example, a shield according to an embodiment of this invention in a classroom of a school, stored on a hook on a wall of the classroom. Assume that an outside person, for whatever reason, comes into the school, presents a threat, and the teacher or another occupant in the classroom becomes aware of the threat. The occupant may quickly access the rolling shield from its storage place on the wall and maneuver the shield to face the classroom door. Should the intruder enter the classroom, the user of the shield may be able to shield herself, and possibly others as well, and may charge the intruder with the shield. This should at least discourage the intruder. If other persons in the school also access shields of this sort, and face the intruder as well, or provide a bullet-proof screen in hallways, the situation may be brought under control for enough time for first responders to arrive and take control. In any case, access to a shield of this sort, especially if there is no avenue of escape, should provide at least some effective protection from the intruder.

Figure 3A:
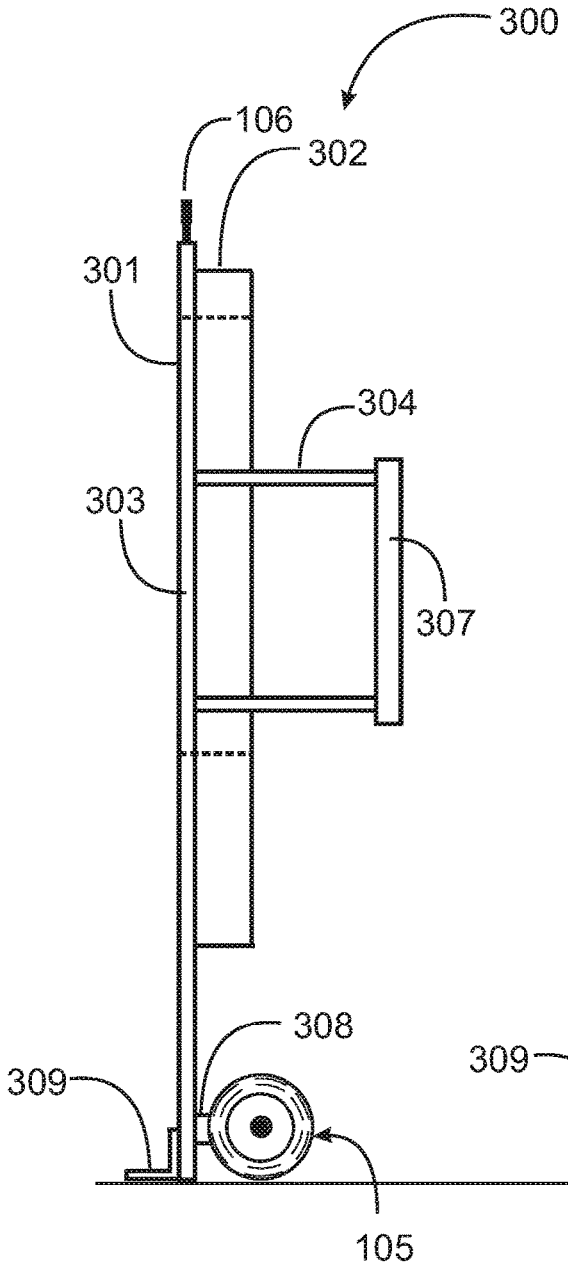
FIG. 3A is an elevation view of an apparatus in an alternative embodiment.
Figure 3B:
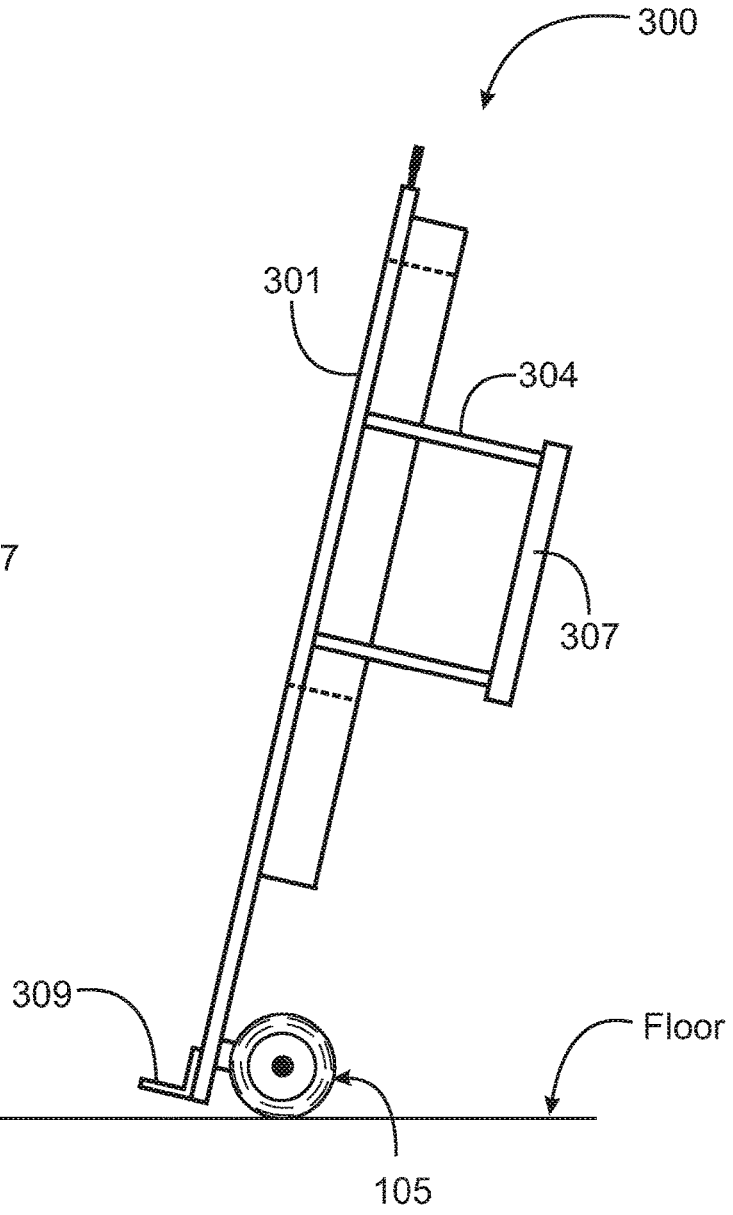
FIG. 3B is an elevation view of the apparatus of FIG. 3A tilted on to the wheels.

In another embodiment of the invention, shown in FIGS. 3A and 3B, a rolling shield is provided with somewhat different elements than the embodiments described above with reference to FIGS. 1, 2A and 2B. This version is shown in FIGS. 3A and 3B. FIG. 3A illustrates a rolling shield 300 comprising a substantially flat shield body 301. Body 301 has the same storage loop 106 as the embodiment referring to FIGS. 2A and 2B. A cushioning pad 302 is affixed to an inside surface of body 301 and is essentially the same as cushioning pad 102 described above.

Cushioning pad 302 has an opening for a window 303, the same as described above for the embodiment of FIGS. 1, 2A and 2B. Handles 307 on either side fasten by posts 304 to body 301 and the handles are essentially the same as handles 107 described above. Wheels 105 fasten to body 301 by axels through brackets 308 and are positioned to nearly touch the floor surface with body 301 resting on the floor surface. The wheels are positioned forward as shown. There is, in this example, a bracket 309 fastened to the front of the body to aid in balancing the apparatus when sitting upright on the floor surface. This bracket is optional, as, in some uses, the apparatus will hang from loop 106 on a wall surface when not in use.

FIG. 3B shows apparatus 300 tilted to bear weight of the apparatus on wheels 105. In this aspect the rolling shield may be deployed as described above for apparatus 100. Apparatus 300 may be less expensive to produce than apparatus 100, and may also be amenable to more efficient storage, by virtue of the flat aspect of the body.

Figure 4A:
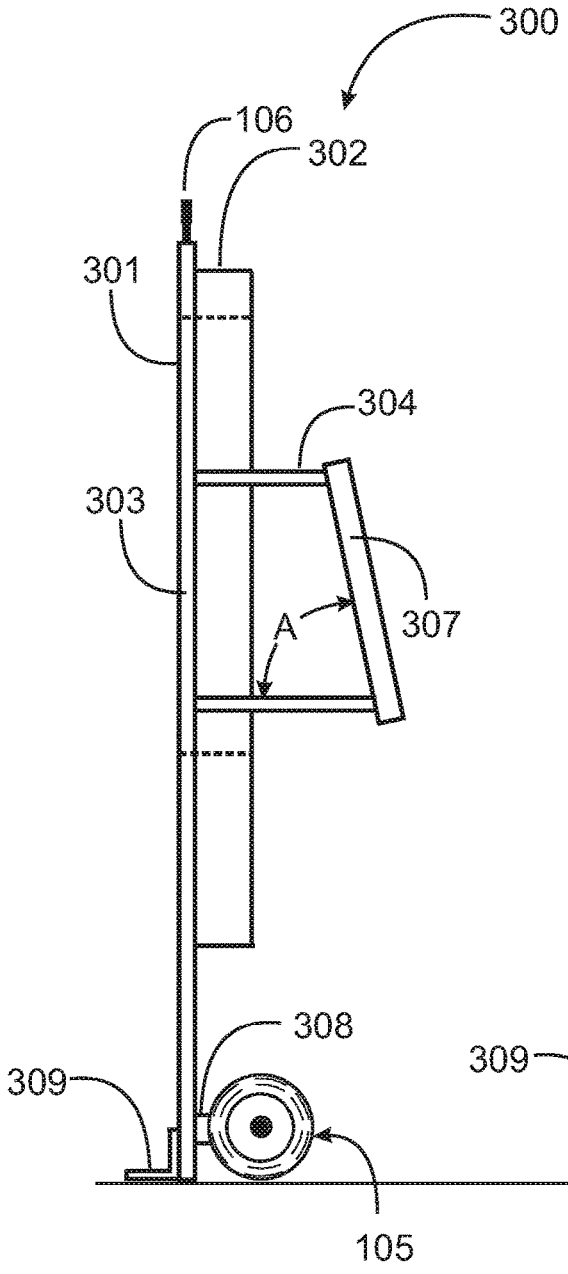
FIG. 4A is a side elevation view of an apparatus in another alternative embodiment.
Figure 4B:
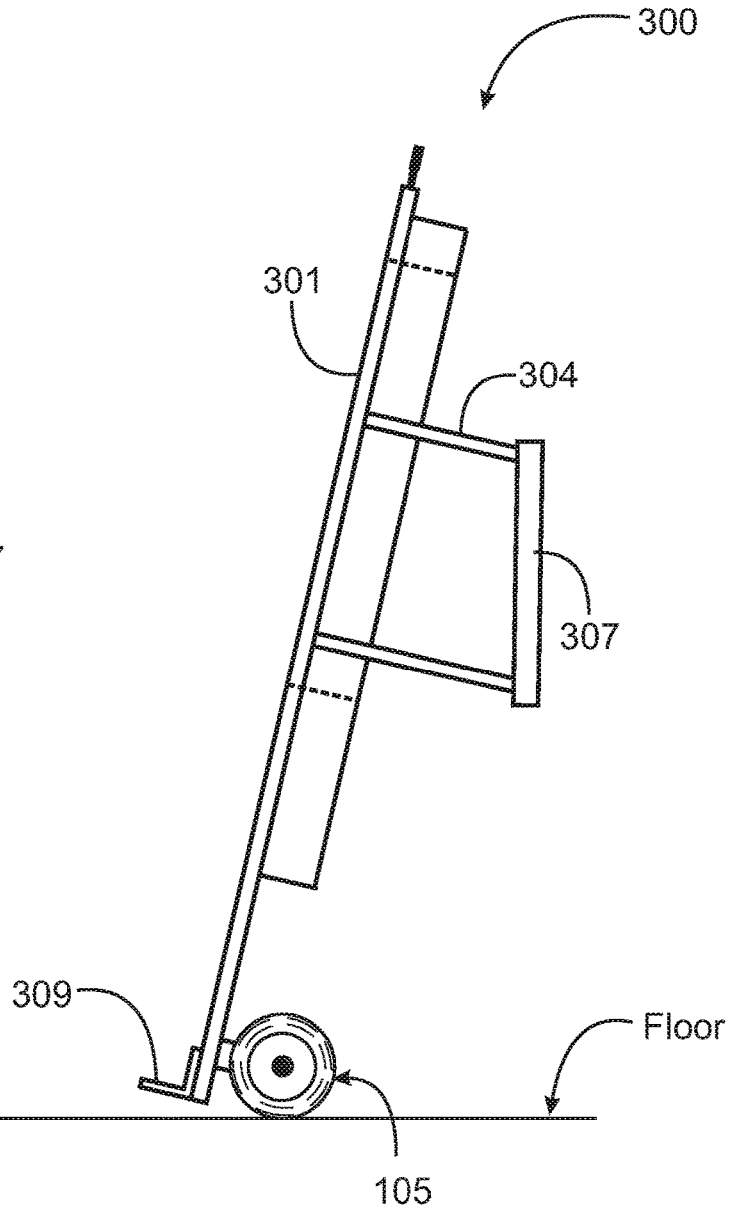
FIG. 4B is an elevation view of the apparatus of FIG. 4A tilted onto the wheels.

An alternative embodiment is illustrated in FIGS. 4A and 4B. The salient difference in this embodiment is that the handle assemblies are provided to be at an angle A with vertical, such that when the apparatus is used at an angle, as shown in FIG. 4B, the handles are vertical, enabling a better grip for the user than might be the case in the handles of FIGS. 3A and 3B. The same tilted handle feature may also be used on the embodiment of FIGS. 1, 2A and 2B.

The inventor has discovered that the embodiments disclosed above have a disadvantage in some circumstances of use. If in use of the shield a user must move the shield quickly to the left or to the right, this maneuver is not easily done with the two-wheel arrangement described above, wherein, with the shield body resting on the ground or floor level the two wheels are slightly above the ground or floor level, and the wheels are brought into play by tilting the shield back toward the user. The inventor has therefore developed an embodiment that may be quickly and easily be moved to the left and right without tilting the shield onto the two wheels.

The shield of the present invention, as described in embodiments above, is provided in some embodiments with a laterally curved body, and in other embodiments with a substantially flat, planar body. The new embodiment for easy side-to-side movement may be provided in a somewhat different way for the curved body versions and the flat body versions.

Figure 5A:
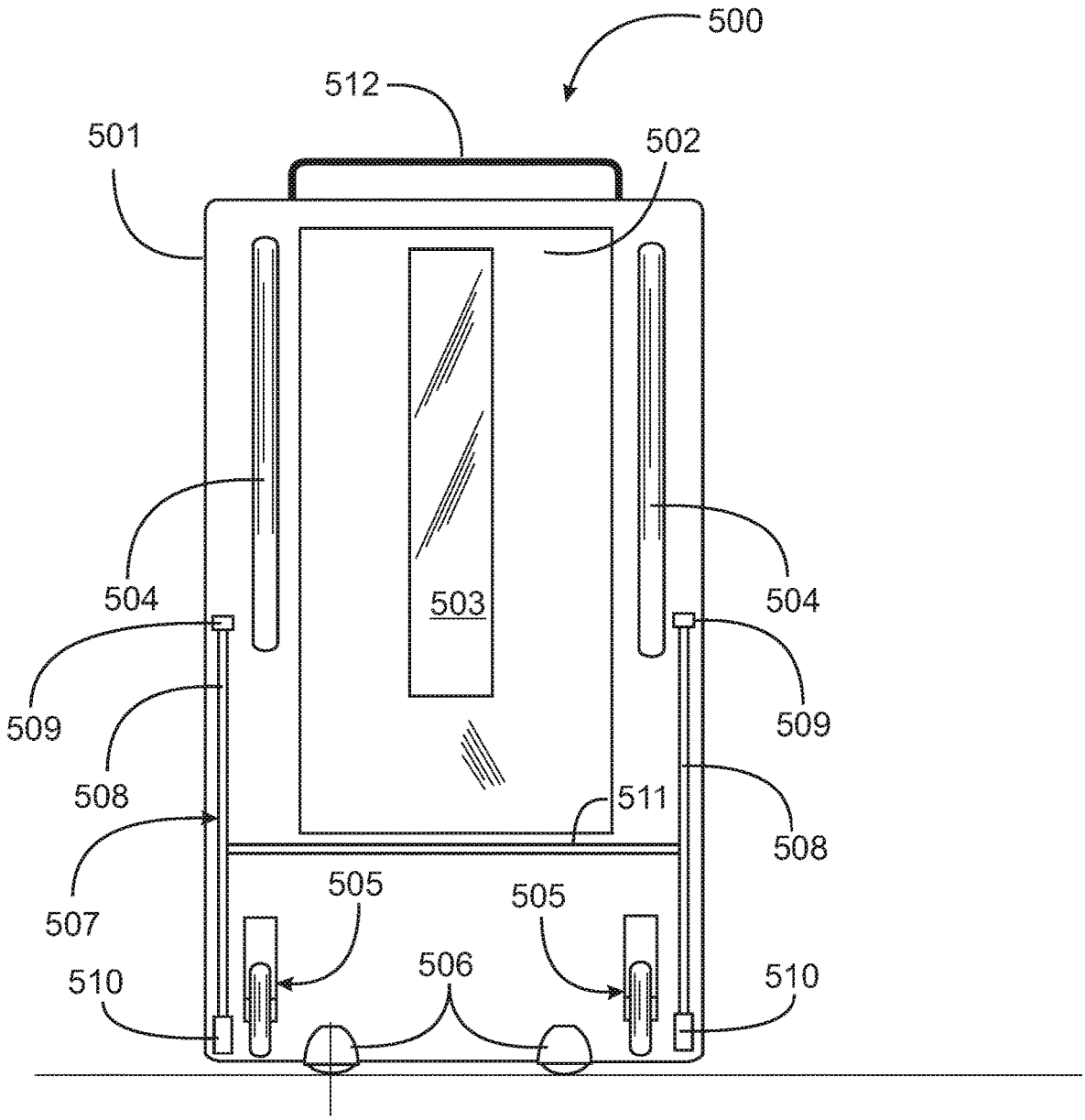
FIG. 5A is a front elevation view of a shield apparatus in a preferred embodiment of the invention.

FIG. 5A is an elevation view of a flat body shield 500 considered by the inventor to be a preferred embodiment. Body 501 in this embodiment is flat and has material specs and dimensions as described above. There is a cushion 502, a bullet-proof window 503 and handles 504. There is a set of extended wheel assemblies 505 as also described above. Shield 500 has a wide upper handle 512 which may be of a width half or more of the total width of body 501 of the shield. There is further a stand assembly 507 comprising vertical struts 508 pivoted in hinges 509 and having end boots 510. Vertical struts 508 are joined by a single lateral strut 511 so the vertical struts move together.

A bottom edge of shield body 501 has, in this example, two cut-out regions wherein two large rollerball bearing assemblies are joined to the body, such that the flat shield body rests on the balls of these rollerball assemblies when standing upright, or when tipped back no more than 10 degrees. The balls of the rollerball bearing assemblies in this example are made of a high molecular weight polymer and may be as large as four inches in diameter. There are ball bearings in the upper housing upon which the large polymer balls rotate.

Figure 5B:
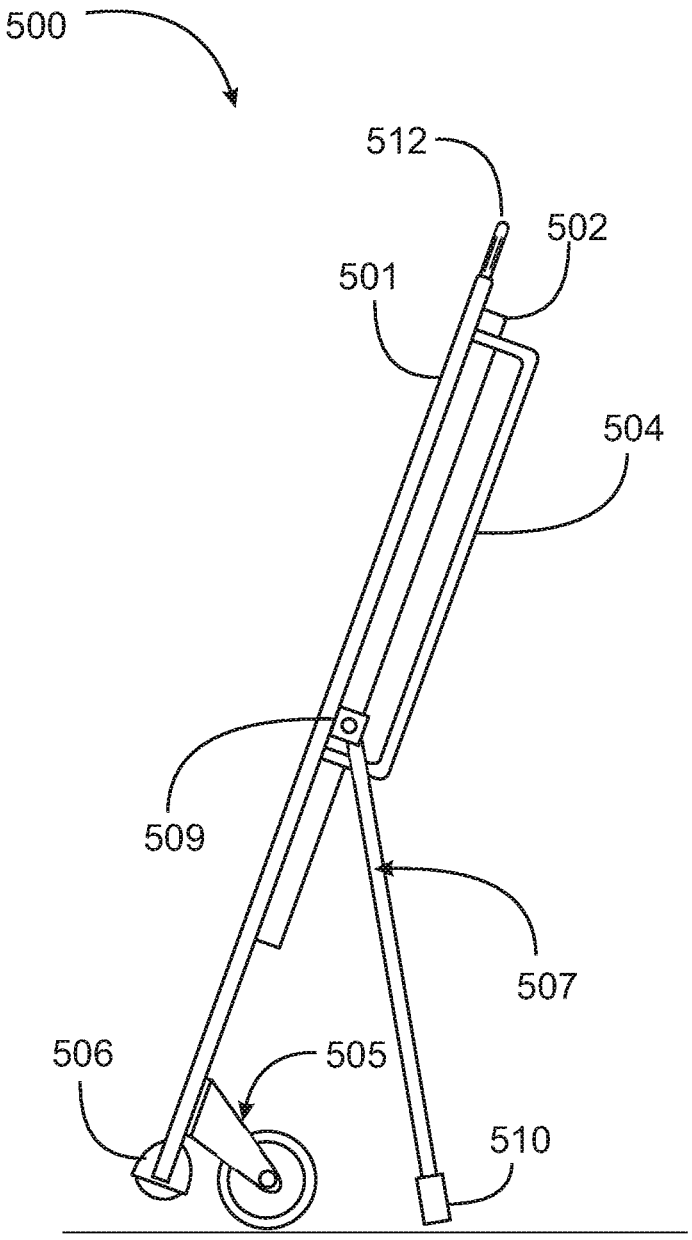
FIG. 5B is a side elevation view of the shield of FIG. 5A.

FIG. 5B is a side elevation view of the shield of FIG. 5A. The stand assembly 507 is extended in this view, and the shield is supported by the stand assembly on the wheels of wheel assemblies 505, tilted at an angle. In one embodiment struts 508 may be telescoping assemblies that may be extended and retracted to change the angle of tilt when the shield is supported on the stand assembly. There may be more than two rollerball assemblies 506.

Figure 5C:
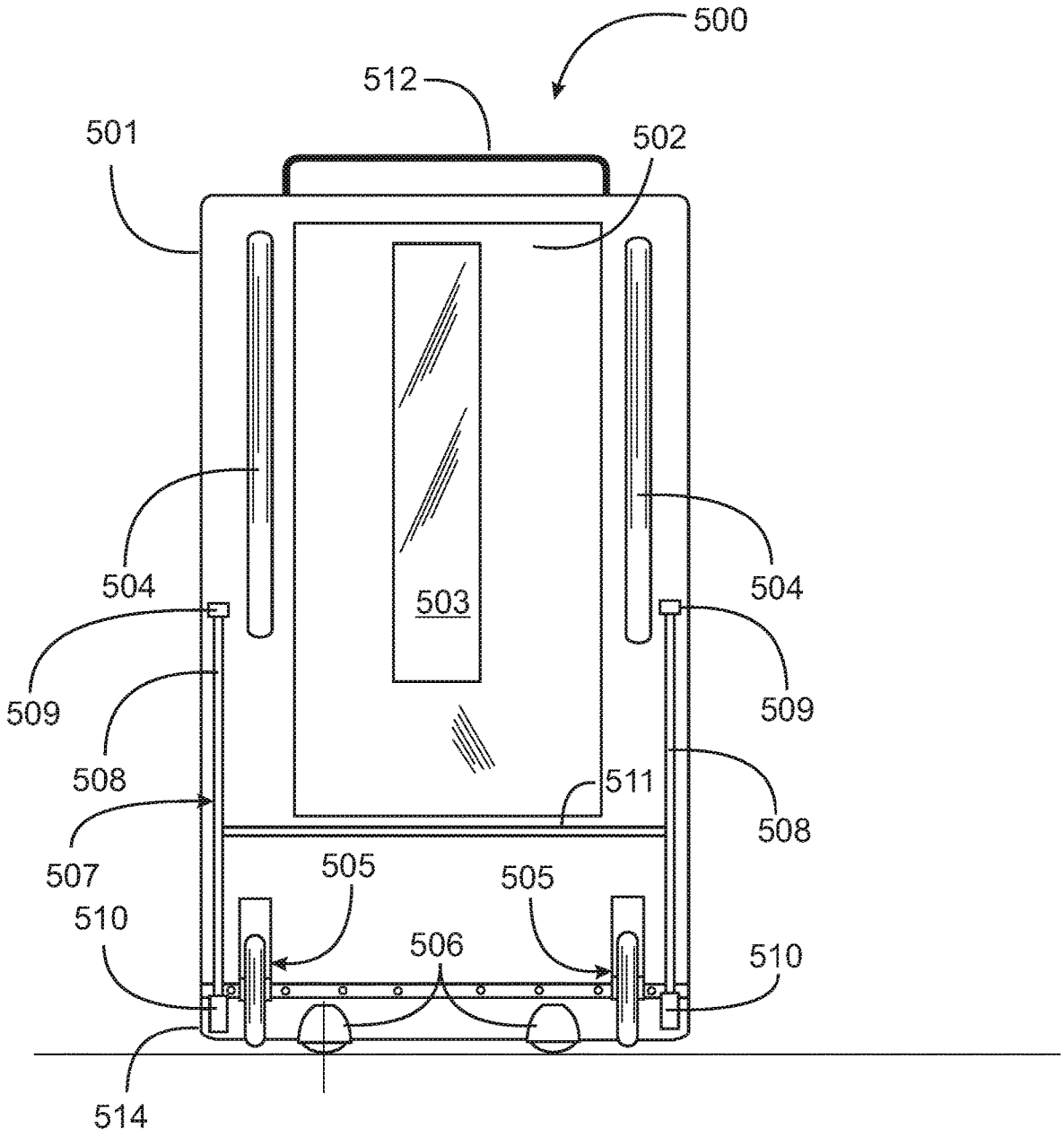
FIG. 5C illustrates a shield in yet another embodiment of the invention.

FIG. 5C is an elevation view of a flat shield like that of FIG. 5A with one difference. The shield in FIG. 5C has rollerballs bearings 506 added by first installing the bearings in a track 514 which is the width of the shield body, and then fastening the track to the body of the shield along the bottom edge, as shown. There may be more than the two rollerball bearings 506 shown.

Figure 5D:
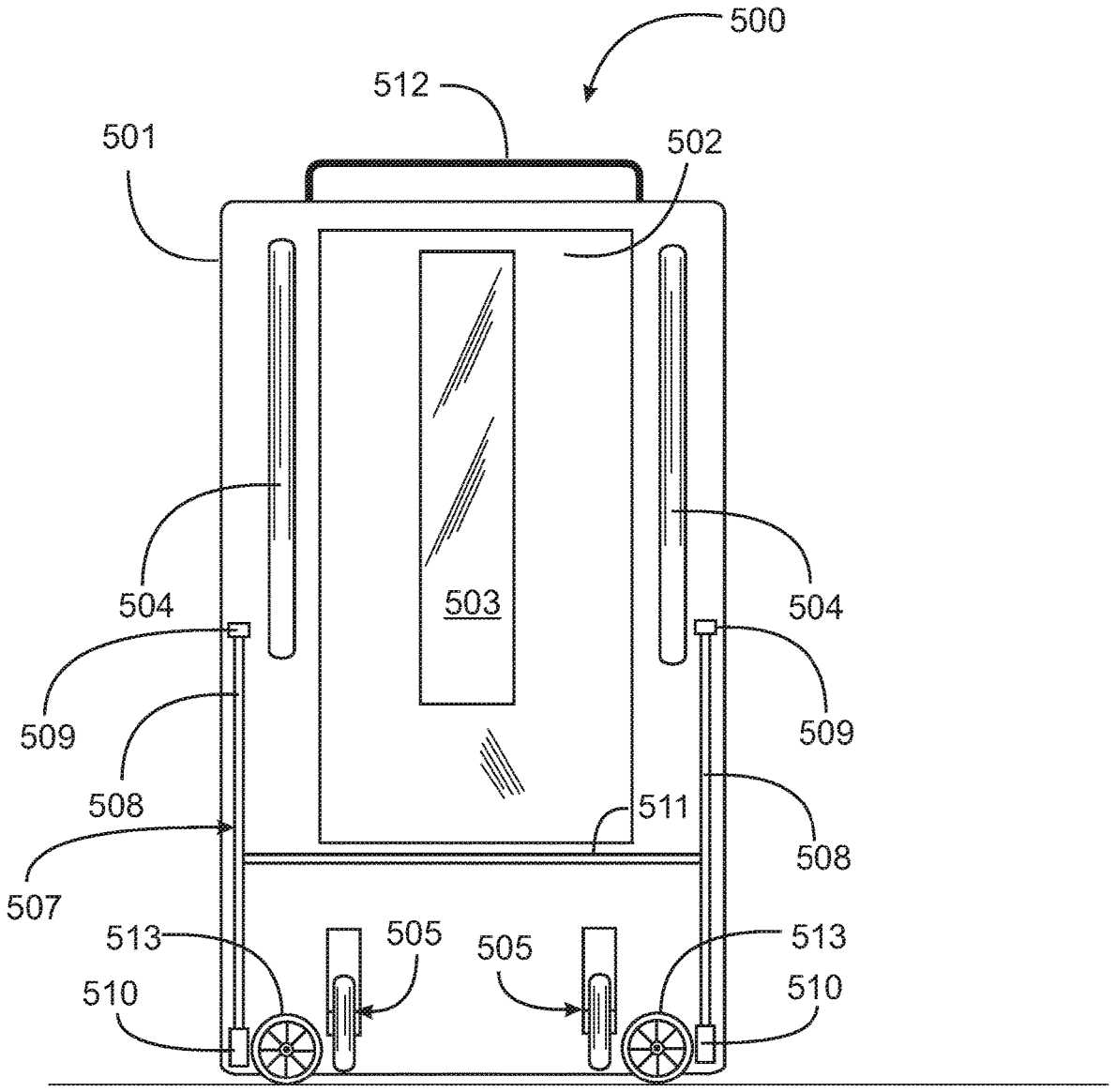
FIG. 5D illustrates a shield in yet another embodiment of the invention.

FIG. 5D illustrates a flat shield similar to that of FIG. 5C with a difference that lateral motion is supported by two wheels 513 rather than by rollerball bearings as in the embodiments of FIGS. 5A, B and C. In the embodiment of FIG. 5D a user may hold the flat shield body upright or tipped back up to 9 degrees by handles 504, with the weight resting on wheels 513, and may move the shield easily and quickly side-to-side, and at any time may tilt the shield back onto wheels 505 to move the shield forward and back.

The person of ordinary skill in the art will understand that the embodiments described herein are entirely exemplary, and do not limit the scope of the invention. The invention may be implemented in a number of ways that may be suggested by the embodiments described, but not explicitly described. The invention is limited only by the claims that follow.

The invention claimed is:

1. A shield, comprising:

a rectangular body having a height of at least sixty inches, a width of at least twenty-four inches, a front side and a back side, a topmost edge and a lowermost edge, the body formed of a bullet-resistant material, with a thickness of at least one-eighth inch;

one or more window openings centered on the width of the body and positioned in an upper half of the body;

bullet-resistant glass panes in the one or more windows, enabling a user to see through the body;

handles positioned along edges of the body on the backside;

two rollerball bearing assemblies each comprising an upper housing and a rollerball with a portion of the rollerball extending below the upper housing, mounted in individual cutout regions implemented along the lowermost edge of the body, such that the upper housing of each rollerball bearing assembly is enclosed in a corresponding cutout region, and the body, supported on the rollerball bearing assemblies on a ground or floor surface, may be translated by the user side-to-side via the rollerballs, wherein the body rests on the rollerball bearing assemblies when standing upright or when tipped back no more than 10 degrees; and two wheels on axles with axes in the direction of the width of the body, the wheels positioned by brackets joined to the backside of the body proximate the lowermost edge, such that with the body vertically oriented and supported on the rollerball bearings the wheels are proximate the ground or floor surface but not touching;

wherein a user, grasping the handles, is enabled to hold the shield oriented vertically supported on the rollerball bearing assemblies, with an opening between the body and the ground or floor surface reduced by virtue of the upper housings of the rollerball bearing assemblies being enclosed in the cutout regions, and to move the shield side-to-side on the rollerballs of the rollerball bearing assemblies, and wherein the user is further enabled to tilt the shield back toward the user, transferring support to the wheels rather than the rollerball bearing assemblies, and is then enabled to move the shield forward and backward on the ground or floor surface on the wheels.

2. The shield of claim 1 further comprising a cushioning pad of flexible, compressible material affixed to the back surface of the body and having openings for the widow openings.

3. The shield of claim 1 further comprising an upper handle extended upward from a top surface of the shield body, across more than half the width of the body.

4. The shield of claim 1 wherein the handles are cylindrical and oriented substantially vertically.

5. The shield of claim 1 wherein the handles are cylindrical and oriented at an angle to vertical of at least fifteen degrees, the top of each handle closer to the shield body.

6. The shield of claim 1 wherein the rollerballs each comprise a polymer ball of at least two inches in diameter.

7. The shield of claim 1 wherein the rollerball bearing assemblies are implemented in a removable linear track that is joined to the lowermost edge of the body.

8. The shield of claim 1 further comprising a stand assembly comprising vertical struts pivoted in hinges positioned about midway on the height of the body proximate opposite side edges of the body, the vertical struts joined by a lateral strut, such that the vertical struts may be extended at an angle to the back side of the body to support the shield stationary at an angle to the ground or floor.

* * * * *